US011209223B2

(12) United States Patent
Streeter et al.

(10) Patent No.: US 11,209,223 B2
(45) Date of Patent: Dec. 28, 2021

(54) HEAT EXCHANGER VANE WITH PARTIAL HEIGHT AIRFLOW MODIFIER

(71) Applicant: Hamilton Sundstrand Corporation, Charlotte, NC (US)

(72) Inventors: James Streeter, Torrington, CT (US); Roberto J. Perez, Windsor, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 176 days.

(21) Appl. No.: 16/562,638

(22) Filed: Sep. 6, 2019

(65) Prior Publication Data

US 2021/0071968 A1 Mar. 11, 2021

(51) Int. Cl.
*F28F 9/22* (2006.01)
*F28D 9/00* (2006.01)

(52) U.S. Cl.
CPC ..... *F28F 9/22* (2013.01); *F28D 9/0068* (2013.01); *F28F 2009/224* (2013.01)

(58) Field of Classification Search
CPC .... F28F 1/422; F28F 3/04; F28F 3/046; F28F 3/048; F28F 3/08; F28F 9/22; F28F 2009/224; F28F 9/0265; F28F 9/0268; F28F 13/12; F28F 2250/02; F28D 9/0062; F28D 9/0068; F28D 2021/0021
See application file for complete search history.

(56) References Cited

U.S. PATENT DOCUMENTS 2,684,690 A * 7/1954 Lee ..... D21F 1/02 137/601.08
2,875,986 A * 3/1959 Holm ..... F28D 9/0068 165/145
3,517,733 A * 6/1970 Holmes ..... F28F 3/025 165/166

(Continued)

FOREIGN PATENT DOCUMENTS

DE 4325977 A1 2/1995
EP 3187809 A1 7/2017

(Continued)

OTHER PUBLICATIONS

Extended European Search Report dated Jul. 6, 2020, received for corresponding European Application No. 19213968.1, 7 pages.

*Primary Examiner* — Jianying C Atkisson
*Assistant Examiner* — Jose O Class-Quinones
(74) *Attorney, Agent, or Firm* — Kinney & Lange, P.A.

(57) ABSTRACT

A heat exchanger includes a stack of flow conduits. Each flow conduit is configured to conduct a fluid. Parting sheets separate adjacent flow conduits in the stack, providing heat transfer between them. Each of the flow conduits includes vanes extending along a vane path and between top and bottom parting sheets. The vanes are separated from one another, thereby creating flow channels. Each flow conduit also includes a plurality of flow modifiers, each adjacent to a corresponding leading edge of a corresponding vane, so as to cause a disrupted portion of a fluid flow to be incident upon the corresponding leading edge. Each of the flow (Continued)

modifiers includes an aerodynamic portion and a gap portion. The aerodynamic portion extends from at least one of the top and bottom parting sheets. The aerodynamic portion does not connect the top and bottom parting sheets due to the gap portion.

20 Claims, 12 Drawing Sheets

(56) References Cited

U.S. PATENT DOCUMENTS 4,064,300 A * 12/1977 Bhangu ..... F23R 3/002 428/120
4,503,908 A * 3/1985 Rosman ..... F28D 9/0018 165/167
4,523,638 A * 6/1985 Rosman ..... F28D 9/0018 165/167
6,179,565 B1 * 1/2001 Palumbo ..... B22C 9/10 416/97 R
6,983,788 B2 * 1/2006 Haglid ..... F28D 9/0081 165/54
9,664,452 B2 * 5/2017 Takada ..... F28D 21/0015
10,196,900 B2 2/2019 King et al.
10,234,217 B2 * 3/2019 Shao ..... F28F 21/04
2007/0221366 A1 * 9/2007 Murayama ..... F28F 3/048 165/166
2008/0134685 A1 * 6/2008 Bunker ..... F23R 3/20 60/776
2008/0149313 A1 * 6/2008 Slaughter ..... F28F 3/048 165/148
2009/0032232 A1 * 2/2009 Murayama ..... F28D 9/0037 165/167
2009/0071638 A1 * 3/2009 Murayama ..... F28F 3/025 165/166
2009/0114372 A1 * 5/2009 Ippoushi ..... F28F 3/12 165/104.14
2009/0321056 A1 * 12/2009 Ran ..... H01L 23/467 165/104.34
2010/0071887 A1 * 3/2010 Sugiyama ..... F24F 12/006 165/166
2010/0302730 A1 * 12/2010 Hernon ..... H05K 7/20145 361/694
2011/0139429 A1 * 6/2011 Salapakkam ..... H01L 23/467 165/185
2011/0192584 A1 * 8/2011 Ishizuka ..... F28F 1/40 165/181
2011/0192796 A1 * 8/2011 Smejtek ..... F28D 9/0093 210/652
2011/0240267 A1 * 10/2011 Blanc ..... F28F 13/06 165/109.1
2012/0012284 A1 * 1/2012 Salamon ..... F28F 3/048 165/109.1
2014/0286768 A1 * 9/2014 Boniface ..... F04D 29/681 415/208.1
2014/0290925 A1 10/2014 Hernon et al.
2015/0361922 A1 * 12/2015 Alvarez ..... F28D 9/0081 165/185
2016/0107274 A1 * 4/2016 Rigal ..... B23K 20/021 165/164
2016/0282064 A1 * 9/2016 Yoon ..... F28F 13/06
2017/0023311 A1 1/2017 Urbanski
2017/0023312 A1 * 1/2017 Urbanski ..... F28F 3/04
2017/0231115 A1 8/2017 Kobayashi et al.
2017/0234622 A1 * 8/2017 Mizushita ..... F28F 3/08 165/166
2017/0328280 A1 * 11/2017 Hussain ..... F02C 7/185
2017/0370609 A1 * 12/2017 Chlup ..... F28F 9/0268
2018/0115031 A1 * 4/2018 Lee ..... B60L 50/64
2018/0292146 A1 10/2018 Furrer et al.
2018/0372416 A1 12/2018 Vargas et al.
2019/0162429 A1 * 5/2019 Armatis ..... F28F 21/066
2019/0178585 A1 6/2019 de Bock et al.

FOREIGN PATENT DOCUMENTS

EP 3234489 A1 10/2017
WO 2013091099 A1 6/2013
WO 2019141513 A1 7/2019

* cited by examiner

HEAT EXCHANGER VANE WITH PARTIAL HEIGHT AIRFLOW MODIFIER

BACKGROUND

The present disclosure relates to heat exchangers, and more particularly, to an additively manufactured heat exchanger with a partial vane design.

Additively manufactured heat exchangers are well known in the aviation arts and in other industries for providing a compact, low-weight, and highly-effective means of exchanging heat from a hot fluid to a cold fluid. Traditional construction imposes multiple design constraints that inhibit performance, increase size and weight, suffer structural reliability issues, are unable to meet future high temperature applications, and limit system integration opportunities. To address some of these concerns, in some heat exchangers, many of the vanes do not extend from the inlet to the core and/or the core to the outlet and are termed partial vanes. Partial vanes are a design compromise, which seek to address the fact that the majority of heat transfer occurs within the counterflow core, and therefore, the size of the crossflow plenums needs to be minimized. Furthermore, from a performance perspective, with continuous vanes the hydraulic diameter at the inlet is considerably smaller, resulting in significant pressure loss.

SUMMARY

A system for heat exchange between a first fluid and a second fluid includes a plurality of parting sheets defining a stack of alternating first and second fluid flow conduits. Each of the first fluid flow conduits is configured to conduct the flow of the first fluid from a first input port to a first output port. Each of the second fluid flow conduits is configured to conduct the flow of the second fluid from a second input port to a second output port. Each of the parting sheets defining the first fluid flow conduits includes a plurality of vanes extending along a vane path from a leading edge to a trailing edge and between first and second parting sheets, separating first and second adjacent second fluid flow conduits. The plurality of vanes are separated from one another in a direction transverse to the vane paths, thereby defining fluid flow channels. The parting sheet defining the first fluid flow conduit also includes a plurality of flow modifiers, each adjacent to a leading edge of a corresponding vane such that the corresponding leading edge is within a disrupted portion of a first fluid flow. Each of the flow modifiers protrudes from at least one of the first and second parting sheets. The flow modifier does not connect the first and second parting sheets.

A method for making a heat exchanger includes providing a plurality of parting sheets defining a stack of alternating first and second fluid flow conduits. Each of the first fluid flow conduits is configured to conduct the flow of the first fluid from a first input port to a first output port. Each of the second fluid flow conduits is configured to conduct the flow of the second fluid from a second input port to a second output port. A plurality of vanes is presented to the flow of the first fluid. The vanes extend along a vane path from a leading edge to a trailing edge and between first and second parting sheets, separating first and second adjacent second fluid flow conduits. The plurality of vanes are separated from one another in a direction transverse to the vane paths, thereby defining fluid flow channels. A plurality of flow modifiers is presented to the flow of the first fluid. The flow modifiers are each adjacent to a leading edge of a corresponding vane such that the corresponding leading edge is within a disrupted portion of a first fluid flow. Each of the flow modifiers protrudes from at least one of the first and second parting sheets. The flow modifier does not connect the first and second parting sheets.

DETAILED DESCRIPTION

In use, the heat exchanger described herein allows for a fluid to flow through channels created between adjacent vanes. The fluid can be, for example, air, fuel, refrigerant, or oil. Alternating fluid flow conduits in the stack can have fluid flowing through them in different, and possibly opposing, directions. These fluid flows can have different properties, such as different temperature, mass flow, viscosity, density, and/or thermal conductivity, for example. The heat from one of the fluid flows is then transferred from the higher temperature fluid flow to the lower temperature fluid flow via the vanes and parting sheets. Most of the heat is transferred in a tubular lattice core of the heat exchanger.

Vanes help to transfer the heat and to direct the fluid flow, but they also add weight and decrease the pressure from the inlet to the outlet ports. In order to mitigate these problems, vanes can be shortened to be partial vanes, which extend only a portion of the distance from input port to output port, in the areas where less heat transfer occurs. Without a flow modifier, the fluid flow is incident on the partial vane leading edge and can create structural stress at the leading edge. A flow modifier can, therefore, be placed adjacent to the vane, upstream from the vane leading edge. The fluid flow is then diverted from the partial vane leading edge, thereby reducing stress. By reducing the height of the flow modifier so that it is only part of the total height of the conduit, the thermally induced stress that would be present on the flow modifier is greatly reduced. The flow modifiers can be used to similarly reduce thermal stress due to flow stagnation on other elements, such as non-removable build supports, that are not aerodynamically optimal. Flow modifiers can also be used in a cascade, where upstream flow modifiers alter the direction of the fluid flow otherwise incident on downstream fluid flow modifiers. This construction allows for the vanes to be concentrated upstream of the counterflow core where the majority of heat transfer occurs and for the vane spacing to vary as needed, while reducing the pressure loss and decreasing the thermally induced stress concentration at the leading edge of the partial vanes.

Figure 1A:
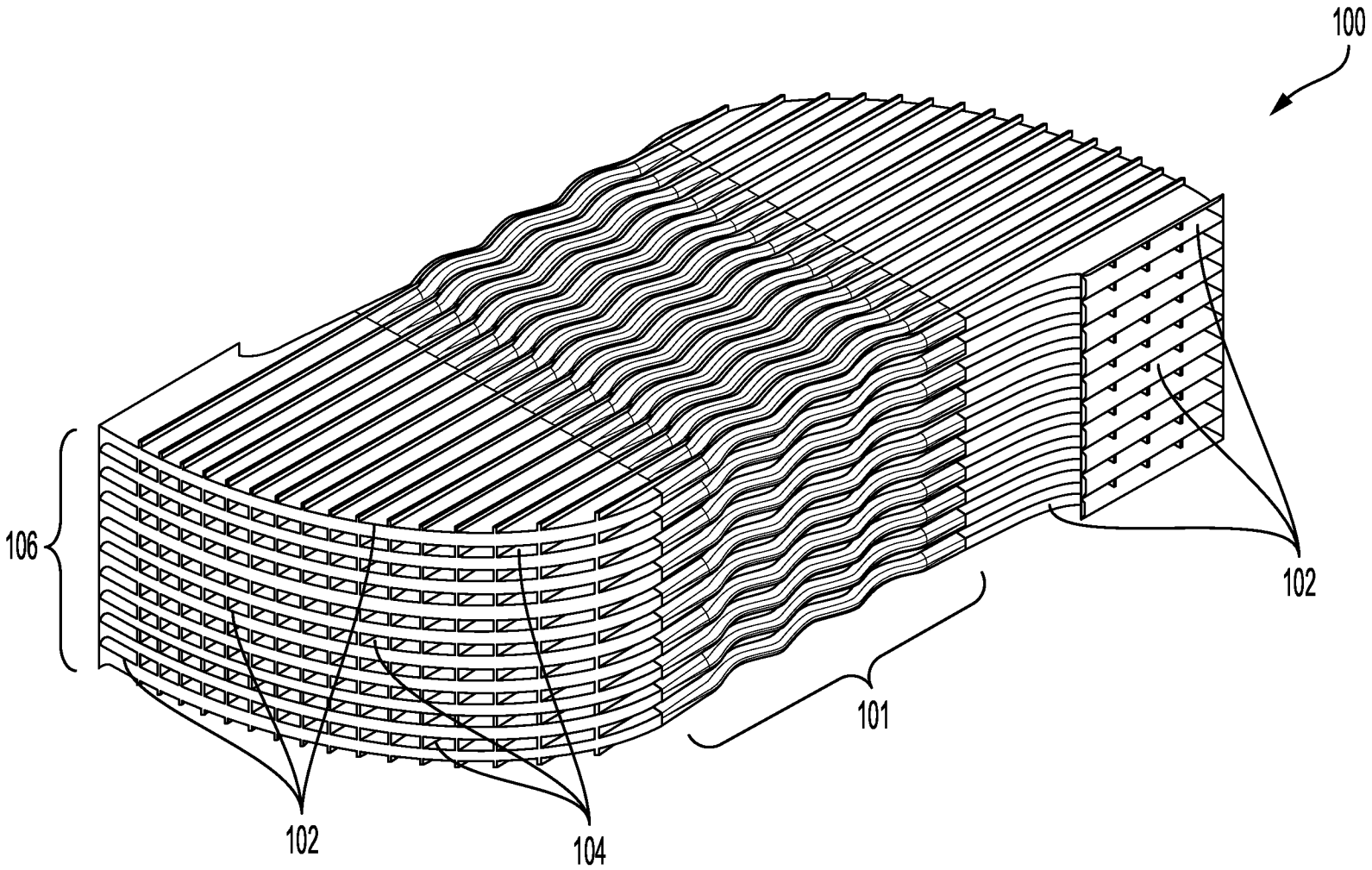
FIGS. 1A-B are perspective and sectional views of a system for heat exchange.
Figure 1B:
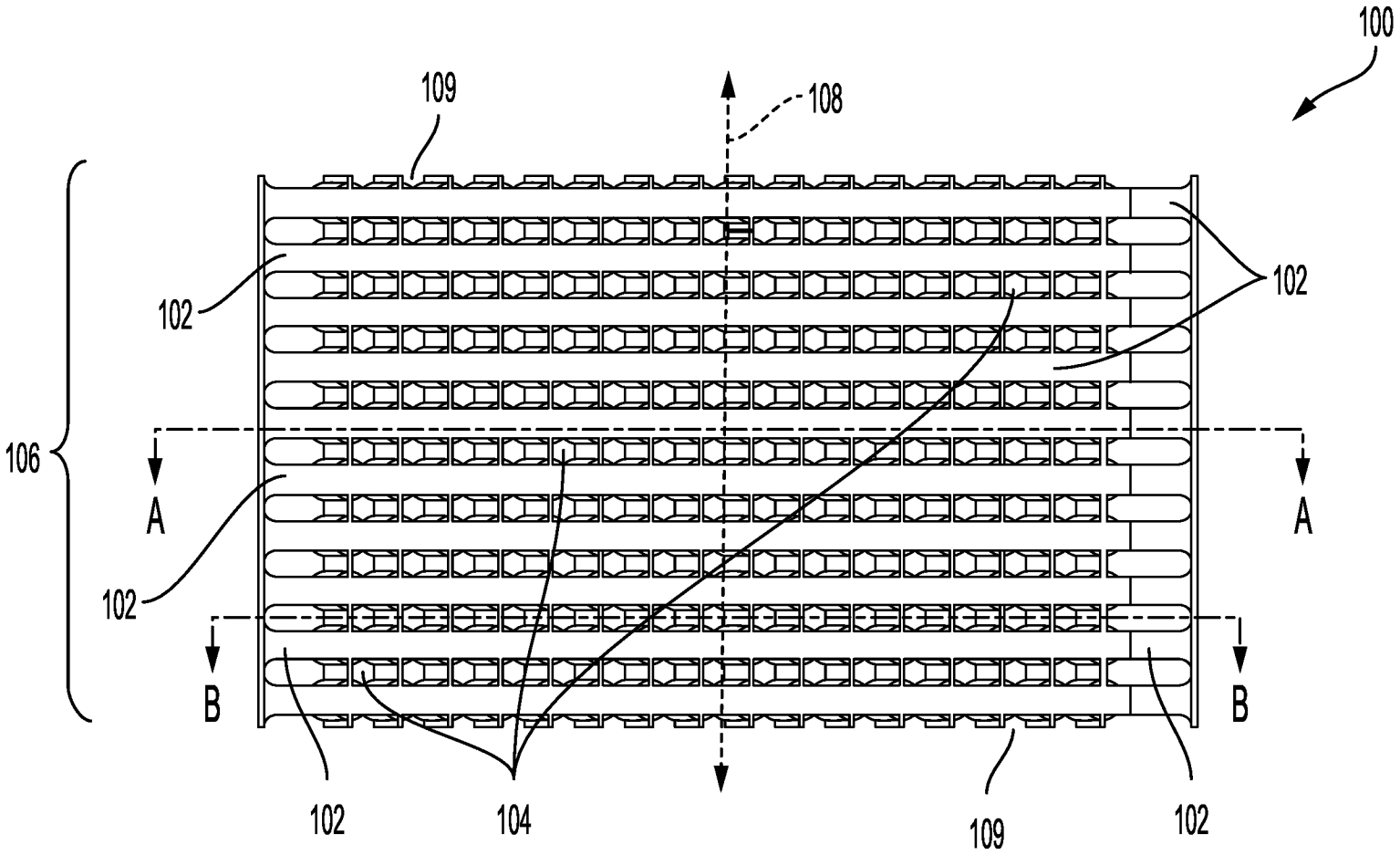
Figure 1C:
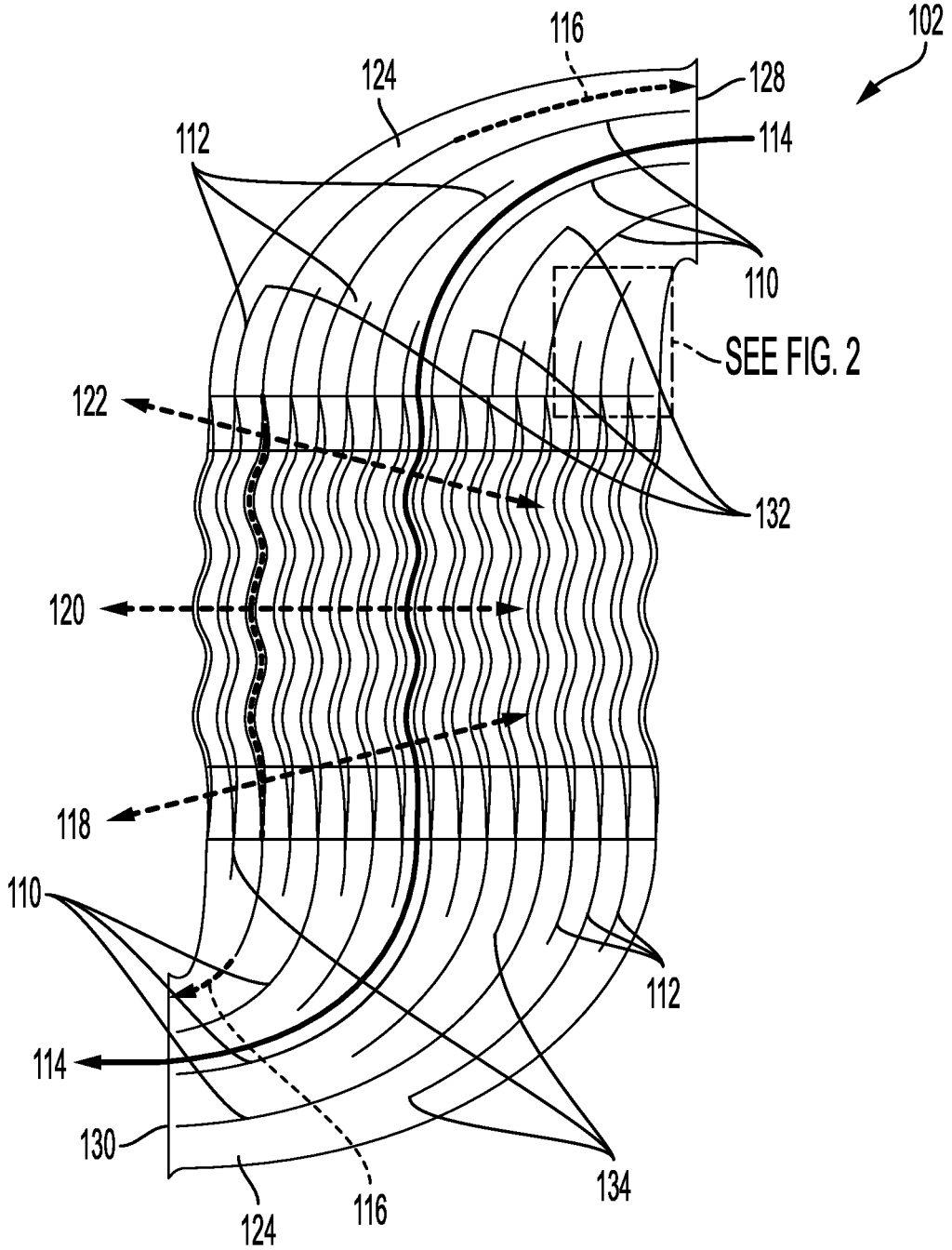
FIGS. 1C-D are plane views of first and second fluid flow conduits of the system depicted in FIGS. 1A-1B
Figure 1D:
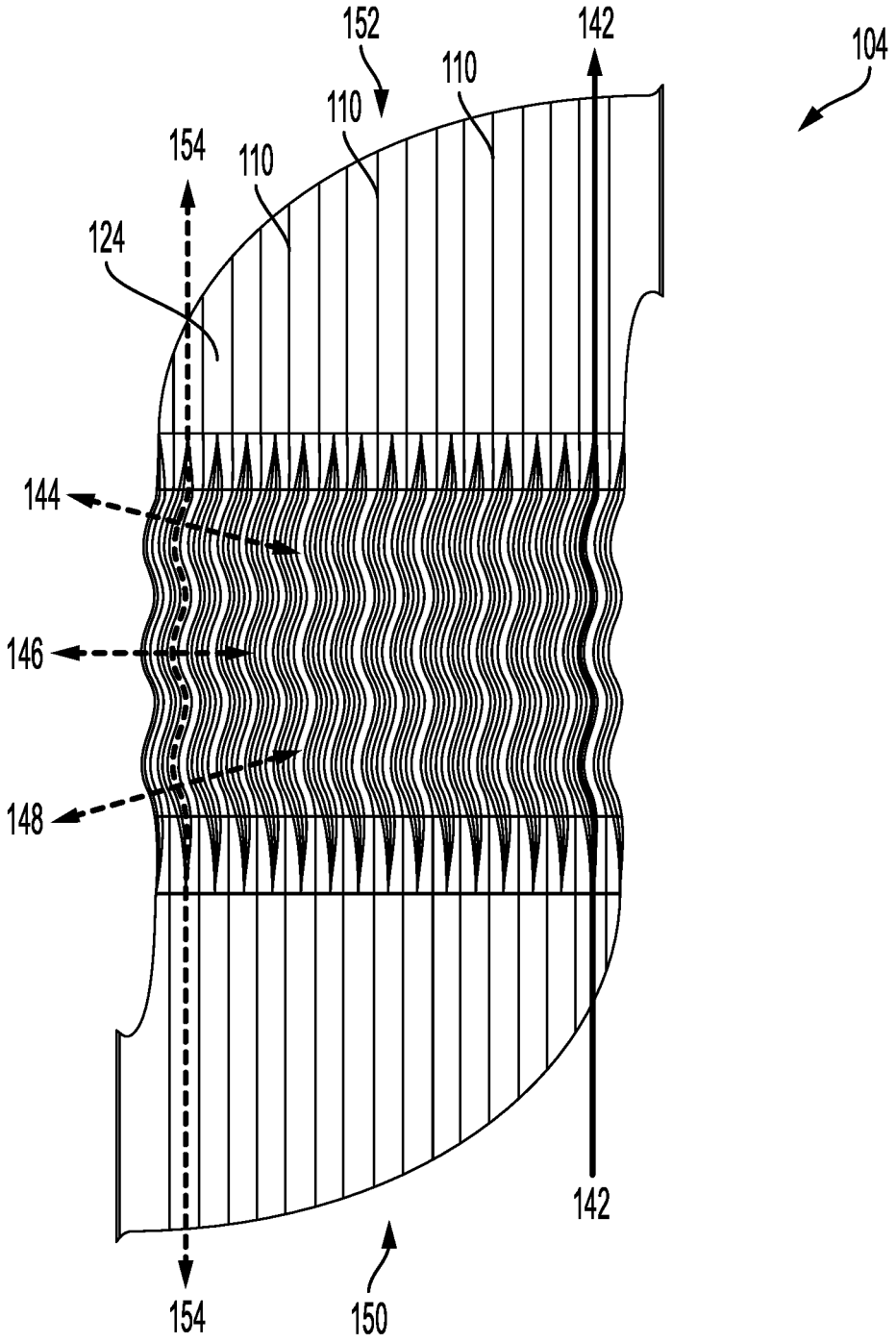

FIG. 1A is a perspective view of heat exchanger 100. FIG. 1B is a side view of heat exchanger 100 of FIG. 1A. FIG. 1C is a sectional view of heat exchanger 100 of FIGS. 1A and 1B taken through plane A-A. FIG. 1D is a sectional view of heat exchanger 100 of FIGS. 1A and 1B taken through plane B-B. Shown in FIGS. 1A-D are counterflow core 101, stack 106, first of alternating fluid flow conduits 102 and second of alternating fluid flow conduits 104, height axis 108, outer layer 109, full vanes 110, partial vanes 112, first fluid flow path 114, second fluid flow path 142, vane path 116, 154, crosswise directions 118, 120, 122, 144, 146, and 148, parting sheet 124, first fluid inlet port 128, second fluid inlet port 150, first outlet port 130, second fluid outlet port 152, leading edges 132, and trailing edges 134.

Heat exchanger 100 can be an additively manufactured heat exchanger. Such a heat exchanger can be formed by powder bed fusion, or other suitable additive manufacturing process. As a result of its manufacture, the heat exchanger can be a single homogenous conductive material article. Parting sheets 124 define first and second of alternating fluid flow conduits 102, 104, which are layers that are designed to direct fluid flow through heat exchanger 100. Stack 106 is collection of fluid flow conduits 102, 104 arranged vertically along height axis 108 in alternating fashion (i.e., first then second then first then second, etc.) sandwiched by outer layers 109. In some embodiments a stack contains at least 9 fluid flow conduits, at least 15 fluid flow conduits, at least 21 fluid flow conduits, or more. In some embodiments stack contains two, three, four, or more configurations of fluid flow conduits such as, for example, fluid flow conduits 102 and 104. Heat exchanger 100 has counterflow core 101, which is a section of the stack where alternating fluid flows are aligned in such a way to promote efficient heat transfer between them.

Vanes 110, 112 are walls which direct the flow of the fluid through heat exchanger 100 and define first and second fluid flow paths 114, 142. Full vanes 110 run the entire length of a heat exchanger. Partial vanes 112 run for only a portion of a heat exchanger. Partial vanes 112 begin at leading edges 132 proximate to first fluid inlet port 128. Downstream from leading edges 132, partial vanes 112 terminate at trailing edges 134 proximate to first outlet port 130. Leading edges 132 of partial vane 112 can be rounded, blunt, tapered, or flared. Vanes 110, 112 can have a height in the range of at least 0.050 inches and no more than 0.5 inches (1.3 mm-13 mm), at least 0.070 inches (1.8 mm) and no more than 0.3 inches (7.6 mm), or at least 0.1 inches (2.5 mm) and no more than 0.125 inches (3.2 mm) measured in the height direction, for example. Vanes can have a width measured in the crosswise direction in a range of at least at least 0.006 inches to no more than 0.020 inches (0.2-0.5 mm), at least 0.008 inches (0.2 mm) to no more than 0.015 inches (0.4 mm), or at least 0.010 inches (0.3 mm) to no more than 0.013 inches (0.3 mm), for example. The distance between vanes can be in a range from at least 0.03 inches to no more than 1 inches (0.8 mm-25 mm), at least 0.2 inches (5 mm) to no more 0.9 inches (22.9 mm), or at least 0.3 inches (7.6 mm) to no more than 0.8 inches (20.3 mm) measured in the crosswise direction, for example. Vanes and partial vanes 110, 112 can be curved or straight in the direction of the vane path. Vanes 110, 112 can include a fillet or a rounding of the corner where the vane comes in contact with the parting sheet 124.

Parting sheet 124 is a plate made of heat conducting material which defines the layers and separates the different fluids, allowing for heat transfer therethrough. First fluid flow conduit 102 is defined by a collection of two parting sheets 124 and vanes 110, 112 that form a single layer of stack 106. A central portion of vanes 110, 112 corresponds to counterflow core 101. A fluid flow conduit can be defined by 10, 12, 16, 20, or more vanes and/or partial vanes. First fluid flow conduit 102 has first fluid inlet port 128 and first outlet port 130, which are openings for the fluid to enter and exit, respectively, first fluid flow conduit 102. Second fluid flow conduit 104 is defined by a collection of two parting sheets 124 and vanes 110 that form a single layer of stack 106. Second fluid flow conduit 104 has second fluid inlet port 150 and second fluid outlet port 152, which are openings for the fluid to enter and exit, respectively, second fluid flow conduit 104.

First fluid flow path 114 is the direction fluid flows through first fluid flow conduit 102. Second fluid flow path 142 is the direction fluid flows through second fluid flow conduit 104. Vane path 116, 154 is the path through a vane parallel to the parting sheet 124. Crosswise direction 118, 120, 122, 144, 146, 148 is the direction transverse to vane path 116, 154 at a given point. Height axis 108 runs perpendicular to both vane path 116, 154 and crosswise direction 118, 120, 122.

Stack 106 alternates between first fluid flow conduits 102 and second fluid flow conduits 104. In some embodiments the fluids can flow through each subset in a different direction. A stack can direct the flow in one, two, three, four, or more directions. Fluid flow for first fluid flow conduits 102 enters first fluid flow conduits 102 at first fluid inlet ports 128 continues along first fluid flow paths 114 as defined by vanes 110, 112. Fluid flow for second fluid flow conduits 104 similarly enters second fluid flow conduit 104 at second fluid inlet ports 150 continues along second fluid flow paths 142 as defined by vanes 110, 112. Both flows can travel through counterflow core 101 simultaneously without mixing, and heat is transferred between them through parting sheets 124 and vanes 110, 112. They then exit their respective fluid flow conduits 102, 104 at first fluid outlet port 130 and second outlet port 150. The use of partial vanes as described allows for efficient heat transfer while decreasing the overall weight and pressure reduction within the system.

Figure 2:
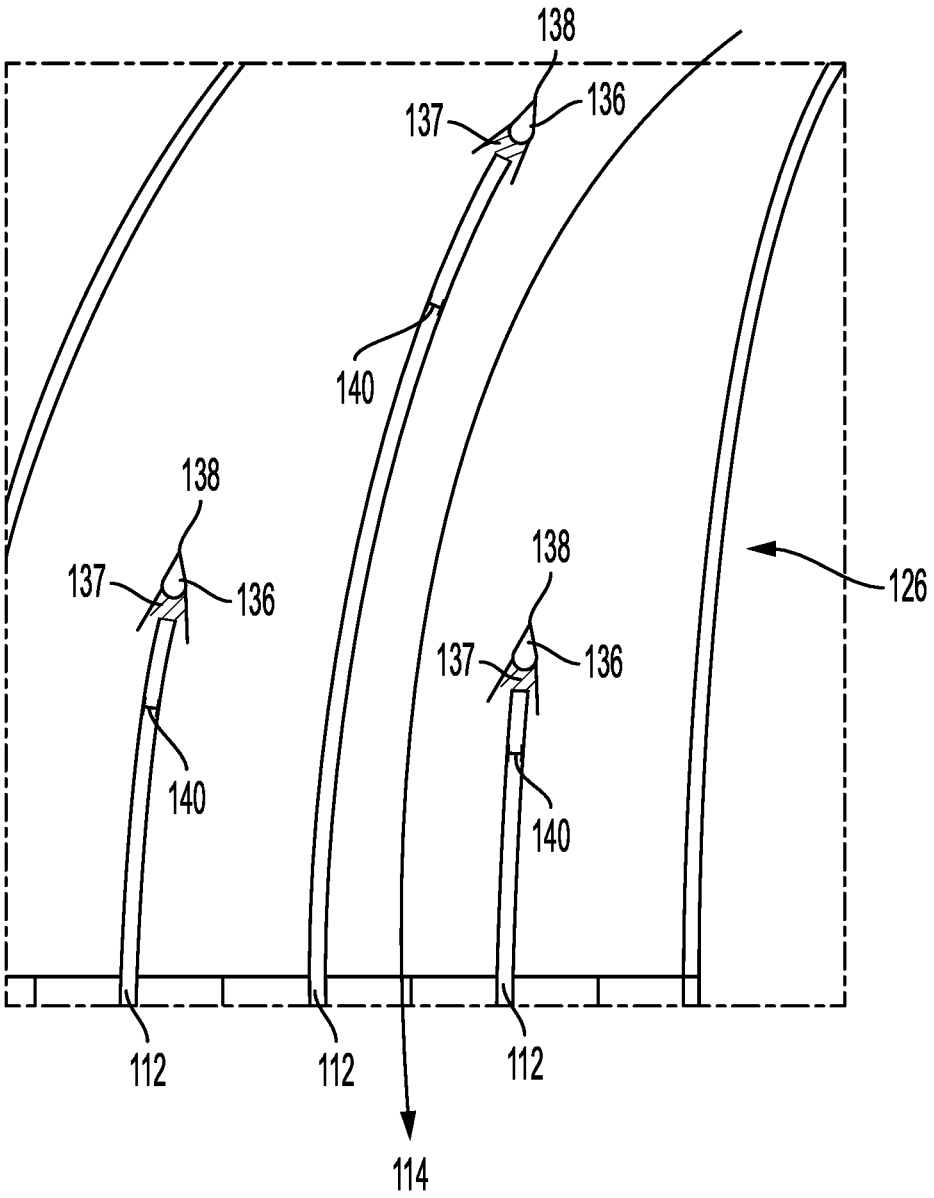
FIG. 2 is a sectional view of the cross section of FIG. 1B showing the detail of a vane tip with a fluid flow modifier.

FIG. 2 is a top view of first fluid flow conduit 102 of FIG. 1C sectional view with portions removed along rectangle B for simplicity. Shown in FIG. 2 are flow modifiers 136, disrupted portion of fluid flow 137, and upstream edge 138, described below, and partial vanes 112, leading edges 132, and vane widths 140 as described above. Flow modifiers 136 are aerodynamically improved structures that divert fluid flow around the leading edges 132 of partial vanes 112. They do not have the same height as partial vanes 112 (e.g. they do not extend all the way between top and bottom parting sheets). Flow modifier leading edge 138 is the edge of flow modifier 136 which is closest to the inlet port. It is, therefore, upstream from the rest of flow modifier 136. Flow modifiers can include a fillet or a rounding of the corner where the flow modifier comes in contact with the parting sheet. Disrupted portion 137 of the fluid flow is the portion of the fluid flow that is downstream from flow modifier 136 where the flow is disrupted along a path toward leading edge 132.

Flow modifiers 136 are placed between first fluid inlet port 128 as depicted in FIG. 1C and partial vanes 112 adjacent to partial vanes 112, upstream from leading edges 132. Flow modifiers 136 disrupt the fluid flow and create disrupted portions 137 of fluid flow. The fluid flow comes into contact with flow modifier 136 at flow modifier leading edge 138 and separates around flow modifier 136. Fluid flow conduits can have one, two, or more flow modifiers per partial vane. Flow modifiers can be placed upstream or downstream from the partial vanes. Flow modifiers protrude from a parting sheet and do not connect the adjacent parting sheets. The use of partial height flow modifiers decreases thermally induced stresses on the partial vanes without significantly increasing the weight. The result is increased longevity for the heat exchanger without sacrificing the benefits obtained by using a partial vane.

Figure 3:
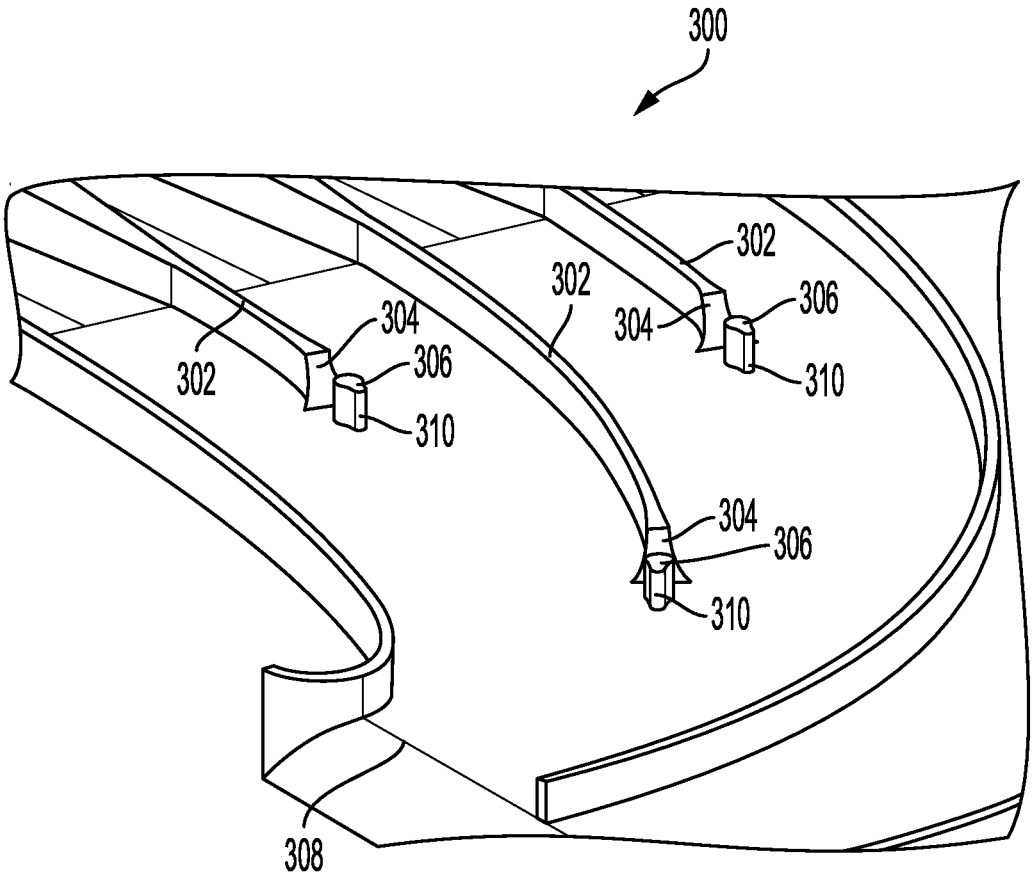
FIG. 3 is a perspective view of a system for heat exchange with portions removed for simplicity showing the detail of a vane tip with a fluid flow modifier.

FIG. 3 is a perspective view of an embodiment of fluid flow conduit 300 with portions removed for simplicity. FIG. 3 shows partial vanes 302, leading edges 304, flow modifiers 306, inlet port 308 and upstream edge 310, as described above. Partial vanes 302 begin at leading edges 304. Flow modifiers 306 are placed between inlet port 308 and partial vanes 302 adjacent to partial vanes 302, upstream from leading edges 304. Flow modifiers 306 disrupt the fluid flow so that it is not incident upon leading edges 304. The fluid flow meets flow modifier 306 at upstream edge 310 and separates around flow modifier 306.

Figure 4A:
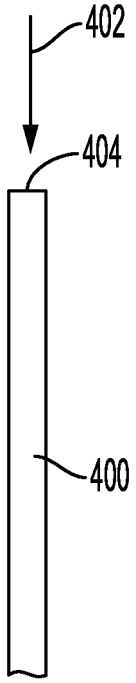
FIGS. 4A-B are top views of a partial vane tip with and without a fluid flow modifier.
Figure 4B:
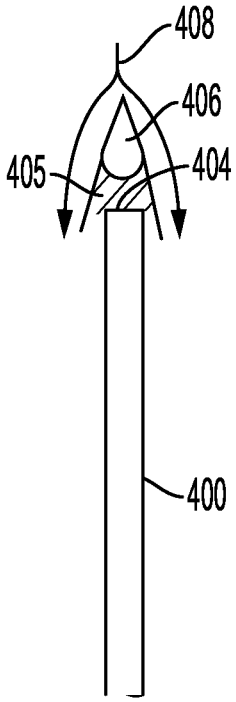

FIG. 4A is a top view of vane 400 without a flow modifier. FIG. 4A shows partial vane 400, fluid flow 402, and leading edge 404, as described above. Fluid flow 402 is incident upon leading edge 404. FIG. 4B, on the other hand, is a top view of vane 400 with fluid flow modifier 406. FIG. 4B shows partial vane 400, leading edge 404, disrupted portion of fluid flow 405, flow modifier 406, and fluid flow 408, as described above. Fluid flow 408 is diverted by flow modifier 406 around vane 400 creating disrupted portion of fluid flow 405. Leading edge 404 is within disrupted portion of fluid flow 405.

Figure 5A:
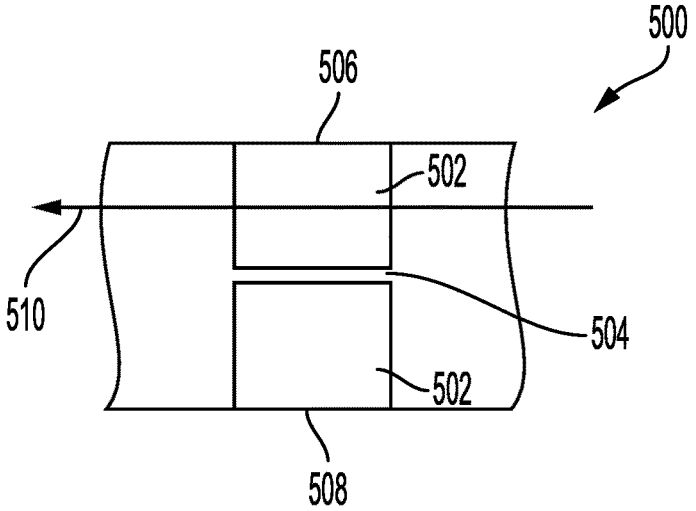
FIGS. 5A-C are side elevation views of the fluid flow modifier with aerodynamic and gap portions.
Figure 5B:
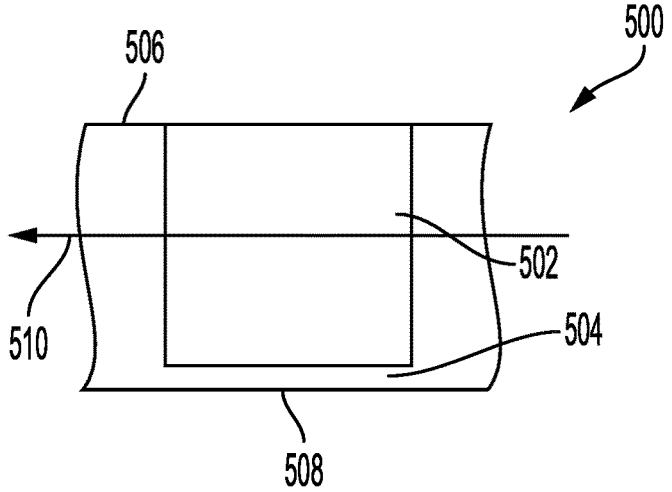
Figure 5C:
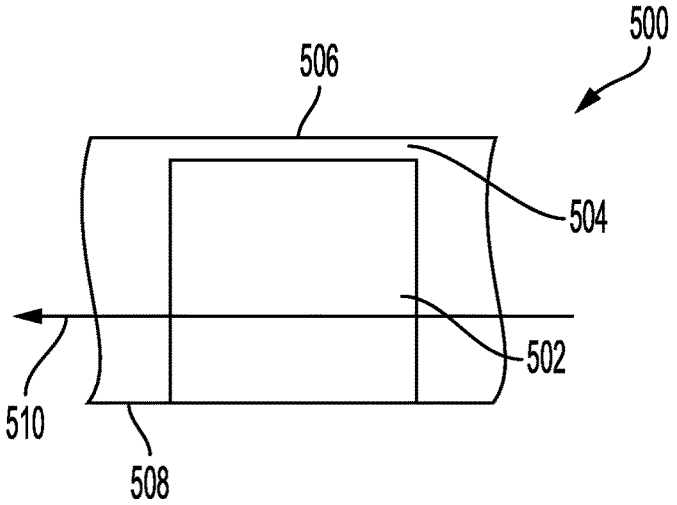

FIGS. 5A-C are side views of alternative embodiments of flow modifiers 500 with portions removed for simplicity. FIG. 5 shows flow modifier 500, first and second parting sheets 506, 508, and fluid flow 510, as described above and aerodynamic portion 502 and gap portion 504, described below.

Aerodynamic portion 502 is a solid portion attached to top parting sheet 506 or bottom parting sheet 508 or both. The aerodynamic portion or portions can have a total height, from bottom parting sheet to top parting sheet, in the range of at least 0.050 inches to no more than 0.5 inches (1.3 mm-13 mm), at least 0.07 inches (1.8 mm) and no more than 0.4 inches (10.1 mm), or at least 0.09 inches (2.3 mm) to no more than 0.3 inches (7.6 mm), for example. The aerodynamic portion can include a fillet or a rounding of the corner where the aerodynamic portion comes in contact with the first parting sheet or the second parting sheet. If the aerodynamic portion is divided, as pictured in FIG. 5A, the aerodynamic portion attached to the first parting sheet can be shorter, taller, or the same size as the aerodynamic portion attached to the second parting sheet.

Gap portion 504 is an open space that extends from one end of flow modifier 500 to the other along the vane path. The gap portion can have a height in a range of at least 0.002 inches (0.05 mm) to no more than 0.020 inches (0.5 mm), at least 0.006 inches (0.2 mm) to no more than 0.15 inches (3.8 mm), or at least 0.008 inches (0.2 mm) to no more than 0.010 inches (0.3 mm), for example. Surface of the aerodynamic portion adjacent to the gap portion can be level, curved, or slanted.

Aerodynamic portion 502 does not connect first parting sheet 506 to second parting sheet 508. Gap portion 504 prevents aerodynamic portion 502 from connecting first parting sheet 506 and second parting sheet 508. Partial height flow modifiers can improve the aerodynamics of the fluid flow conduits, and, because the aerodynamic portion does not connect the first and second parting sheet, little if any stress is incurred.

Figure 6A:
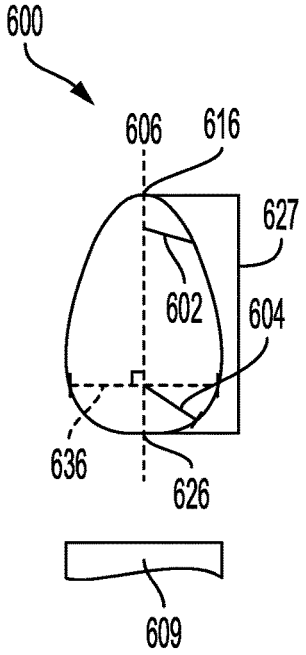
FIGS. 6A-D are top views of possible embodiments of the fluid flow modifier.
Figure 6B:
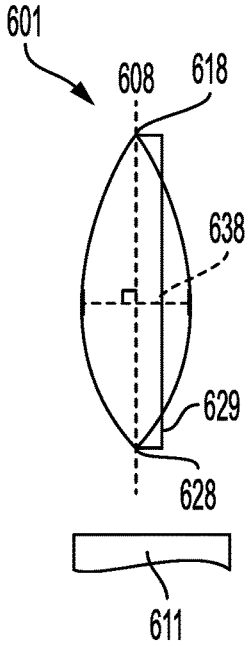
Figure 6C:
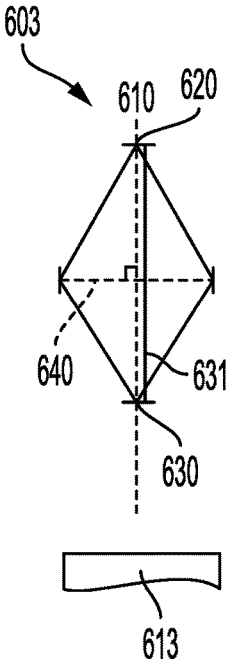

FIGS. 6A-6D are top views of various possible embodiments of various flow modifiers. FIGS. 6A-6D show upstream edges 616, 618, 620, 624, and partial vanes 609, 611, 613, and 617 as described above, flow modifiers 600, 601, 603, 607 leading radius 602, trailing radius 604, axes 606, 608, 610, 614, downstream edges 626, 628, 630, 634, axial lengths 627, 629, 631, 635, and widths 636, 638, 640, 644, as described below. Flow modifier 600 can be any aerodynamically suitable shape, for example, tear drop (FIGS. 6A and 6D), airfoil (FIG. 6B), oval, or double wedge (FIG. 6C). Downstream edges 626, 628, 630, 634 are the edges of the flow modifiers that are furthest along the flow path, toward the outlet port. Leading radius 602 is the radius of the arc of upstream edge 616. Trailing radius 604 is the radius of the arc of downstream edge 626. Axes 606, 608, 610, 614 are axes which runs from leading edges 616, 618, 620, 624 to trailing edges 626, 628, 630, 634 and generally parallel to the fluid flow path. The axial lengths are the length along axes 606, 608, 610, 614 from upstream edges 616, 618, 620, 624 to downstream edges 626, 628, 630, 634. Widths 636, 638, 640, 646 of the flow modifiers are measured perpendicular to axes 606, 608, 610, 614 at the widest point of the flow modifier. The flow modifier can have a width measured in the crosswise direction in the range of at least 0.006 inches to no more than 0.020 inches (0.2-0.5 mm), at least 0.008 inches (0.2 mm) to no more than 0.015 inches (0.4 mm), or at least 0.010 inches (0.3 mm) to no more than 0.013 inches (0.3 mm), for example. Vanes can have a width measured in the crosswise direction in a range of at least at least 0.006 inches to no more than 0.020 inches (0.2-0.5 mm), at least 0.008 inches (0.2 mm) to no more than 0.015 inches (0.4 mm), or at least 0.010 inches (0.3 mm) to no more than 0.013 inches (0.3 mm), for example.

Figure 6D:
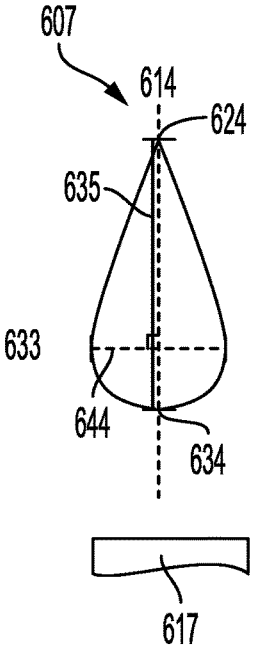

Flow modifier 600 in FIG. 6A has upstream radius 602 and a downstream radius 604 with the lateral dimension of the flow modifier enlarging at an angle from leading radius 602 to the trailing radius 604. The tear drop shape can also be pointed as seen in FIG. 6D.

Flow modifier 601 in FIG. 6B is an airfoil shape, which has a taper at upstream edge 618 and at downstream edge 628. Width 638 is near the half way point of axial length 629. The lateral sides are curved.

Flow modifier 603 in FIG. 6C is a double wedge shape. Like flow modifier 601, flow modifier 603 has a taper at upstream edge 620 and at downstream edge 630. Width 640 is near the half way point of axial length 631. Unlike flow modifier 601, however, the edges of flow modifier 603, are straight.

Vanes 609, 611, 613, 615, 617, and flow modifiers 600, 601, 603, 605, 607 can have the same width or can have different widths. Vanes can have a width measured in the crosswise direction in a range of at least at least 0.006 inches to no more than 0.020 inches (0.2-0.5 mm), at least 0.008 inches (0.2 mm) to no more than 0.015 inches (0.4 mm), or at least 0.010 inches (0.3 mm) to no more than 0.013 inches (0.3 mm), for example. The flow modifier can have an axial length that is at least as great as the width of the flow modifier to no more than four times the width of the flow modifier, at least 1.5 time the width of the flow modifier to no more than 3.5 times the width of the flow modifier, or at least twice the width of the flow modifier to no more than three times the width of the flow modifier, for example. In further embodiments, the axial length of the flow modifier can be substantially equal to the width of the flow modifier.

Substantially means within 10%, within 5%, or within 2%, for example. The distance between the vane terminus and the trailing edge of the flow modifier is in the range of at least the axial length to no more than 2.5 times the axial length, at least 1.25 times the axial length to at least two times the axial length, or at least 1.5 times the axial length to no greater than 1.75 times the axial length, for example. In further embodiments, the distance between the van terminus and the trailing edge of the flow modifier can be substantially equal to the axial length. Substantially means within 10%, within 5%, or within 2%, for example.

The flow modifier can be any shape suitable to produce the aerodynamic effects desired, and the shapes of FIGS. 6A-6D are examples of shapes that are particularly suitable to divert fluid flow, change flow direction, or both.

Figure 7:
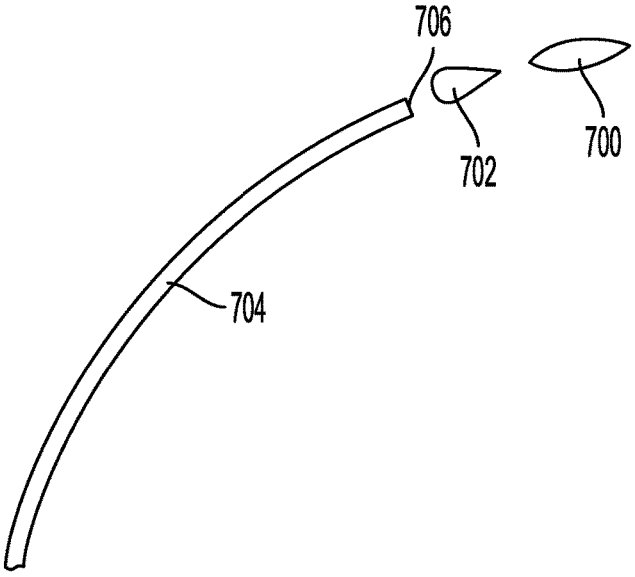
FIG. 7 is a top view of a cascade of flow modifiers.

FIG. 7 is a top view of cascade fluid flow modifiers. FIG. 7 shows flow modifier 702, partial vane 704, and leading edge 706 as described above, and directional flow modifier 700. Directional flow modifier 700 is a second flow modifier placed upstream from flow modifier 702. Directional flow modifier can improve aerodynamic flow, alter the direction of the flow path, or both.

As described above, flow modifier 702 is placed upstream from and adjacent to partial vane 704. In use, the directional flow modifier 700 alters the path of the fluid flow to properly orient it with respect to flow modifier 702 and partial vane 704 thereby ensuring that the disrupted portion is incident upon the leading edge of the vane. Flow modifier 702 then alters the flow path to create a disrupted portion incident upon leading edge 706 of partial vane 704. Using a cascade of flow modifiers allows for the path to be altered without adding significant weight to the heat exchanger and while also maintaining the benefits of a partial vane with or without a single flow modifier.

Figure 8A:
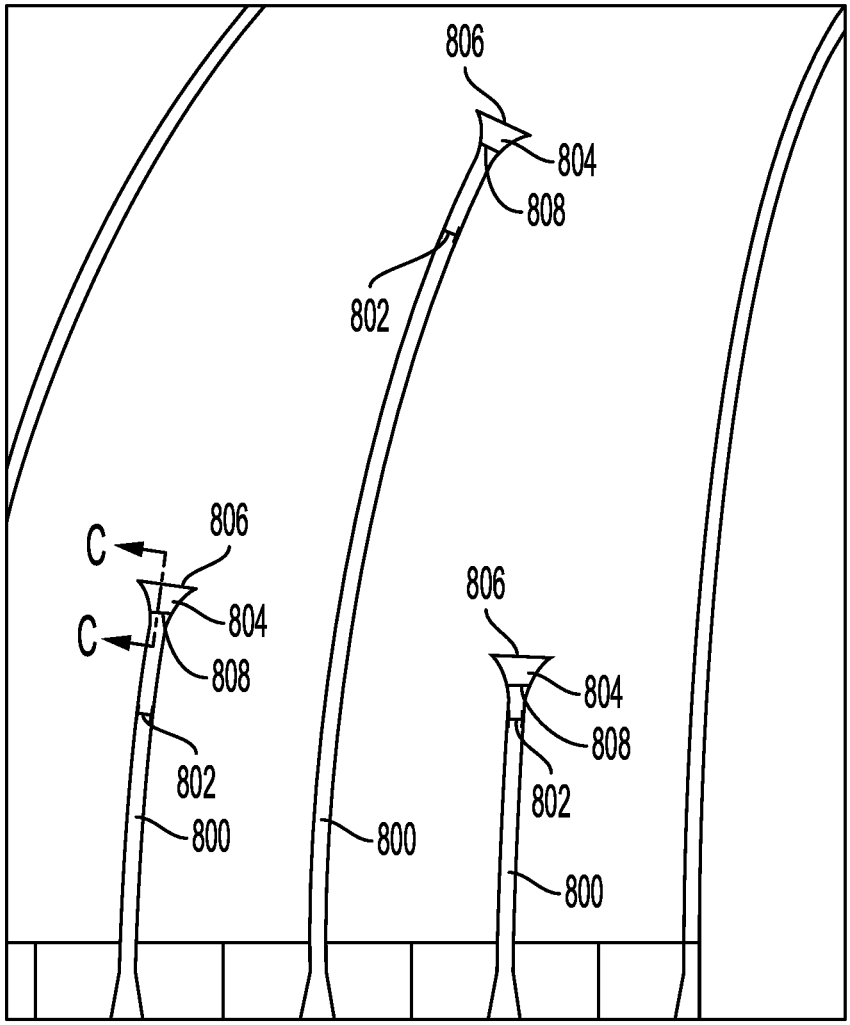
FIGS. 8A-C are sectional and perspective views of a fluid flow conduit showing the detail of a flared vane tip.
Figure 8B:
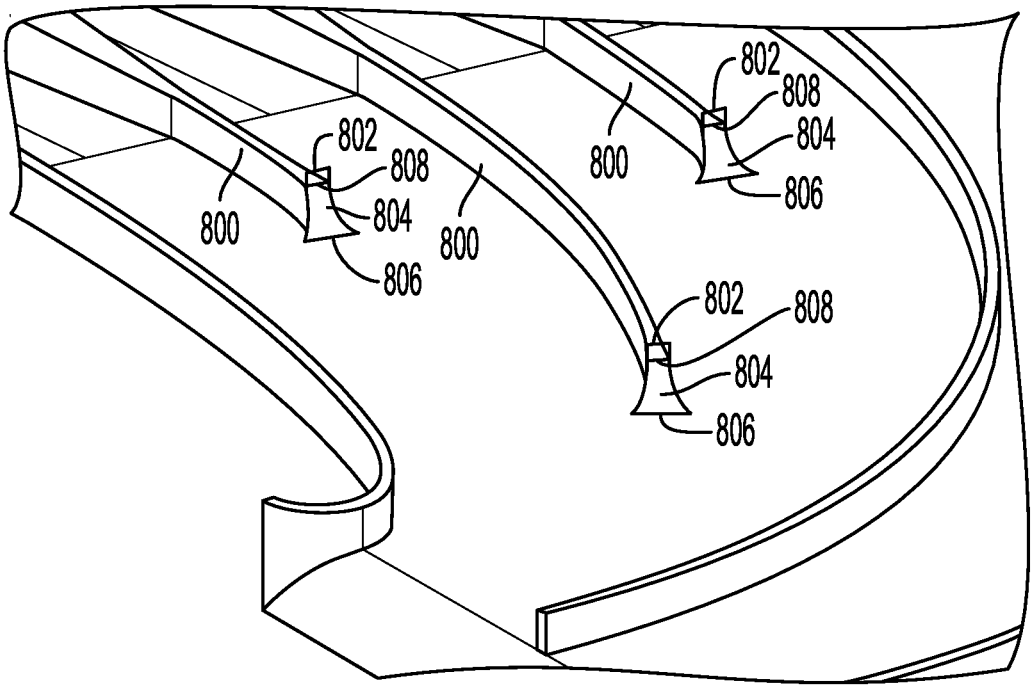
Figure 8C:
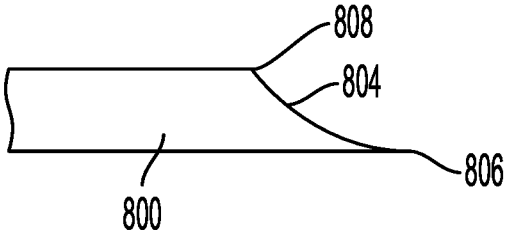

FIG. 8A is a top sectional view of a fluid flow conduit showing the detail of a flared vane leading edge with portions removed for simplicity. FIG. 8B is a perspective view of the fluid flow conduit of FIG. 8A portions removed for simplicity showing the detail of the flared vane leading edge. FIG. 8C is a sectional side view of the fluid flow conduit of FIG. 8A portions removed for simplicity showing the detail of the flared vane leading edge taken through line C-C. FIGS. 8A-8C show vanes 800 as described above, vane width 802, leading edge 804, flare terminus 806, and vane terminus 808. In this embodiment, partial vanes 800 have vane width 802 measured along the crosswise direction. Partial vane 800 ends at vane terminus 808. Leading edge 804 is the upstream edge portion of vane 800. Leading edge 804 begins at vane terminus 808 and ends at flare terminus 806. The profile of leading edge 804 taken along line C-C can be concave and/or defined by an elliptical path.

Leading edge 804 has a width measured along the crosswise direction that at vane terminus 808 equal to vane width 802 and flares outward in the upstream direction. The width of flare terminus 806 is greater than vane width 802. The width of flare terminus 806 measured along the crosswise direction can be at least one times the vane width and no more than four times the vane width, at least 1.3 times the vane width and no more than 3.5 times the vane width, or at least 1.5 times the vane width and no more than 3 times the vane width, for example. In further embodiments, the width of the flare terminus can be substantially equal to the vane width. Substantially means within 10%, within 5%, or within 2%, for example. The length of the leading edge measured from vane terminus 808 to flare terminus 806 along the plane defined by the vane path and the crosswise direction can be at least one times the vane width and no more than four times the vane width, at least 1.3 times the vane width and no more than 3.5 times the vane width, or at least 1.5 times the vane width and no more than 3 times the vane width, for example. In further embodiments, the length of the leading edge can be substantially equal to the vane width. Substantially means within 10%, within 5%, or within 2%, for example. Flare terminus 806 can be curved, straight, or at an angle relative to the crosswise direction. The sides of leading edge 804 can be curved or straight. Flared leading edges 804 with an elliptical cut reduce thermally induced stress on partial vane 800.

Figure 9A:
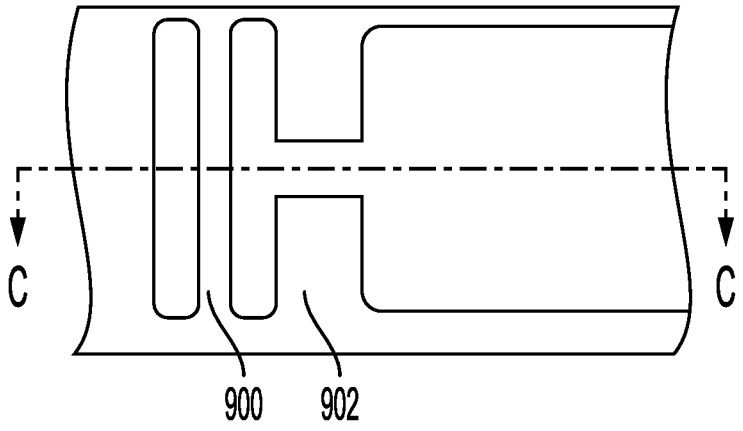
FIGS. 9A-B are side and sectional views of fluid flow modifiers upstream from a build support.
Figure 9B:
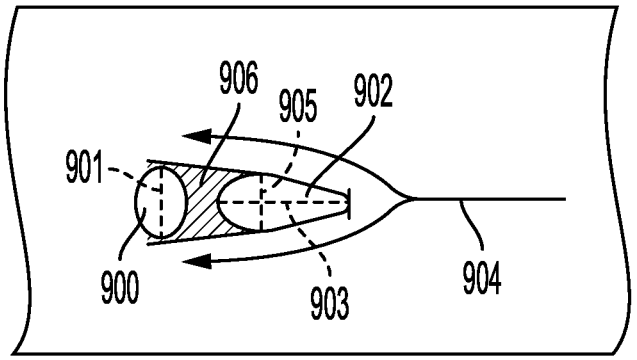

FIG. 9A is a side view of a fluid flow conduit with a structural support and a flow modifier with portions removed for simplicity. FIG. 9B is a top view of a fluid flow conduit with a structural support and a flow modifier taken through line C-C with portions removed for simplicity. FIGS. 9A and 9B show structural support 900, structural support width 901, axial length 903, flow modifier 902, flow path 904, flow modifier width 905, and secondary disrupted portion 906.

Structural support 900 is a member connecting the parting sheets that provides additional structure to the fluid conduit and/or assists in its manufacture. Structural support 900 can include a fillet or a rounding of the corners where structural support 900 contacts the parting sheet. Structural support width 901 is distance from one edge of structural support 900 to an opposite edge at the widest point of structural support 900 taken in the direction transverse to flow path 904. Width of flow modifier 905 is the distance from one edge of flow modifier 902 to the opposite edge at the widest point of flow modifier 902 taken in the direction transverse to flow path 904. Axial length 903 is the distance from the upstream most edge of flow modifier 902 to the downstream most edge of flow modifier 902 measured in the direction of flow path 904. Secondary disrupted portion 906 is the portion of fluid flow 904 downstream from flow modifier 902 where fluid flow 904 is altered from its original path toward structural support 900.

The width of the flow modifier can be the same or different than the width of the structural support. The width of the structural support and flow modifier can be at least 0.02 inches to no more than 0.1 inches (0.5 mm-2.5 mm), at least 0.04 inches (1.0 mm) to no more than 0.09 inches (2.3 mm), or 0.05 inches (1.3 mm) to 0.07 inches (1.8 mm), for example. The flow modifier can have an axial length that is at least the same length as the width of the flow modifier to no more than four times the width of the flow modifier, at least 1.5 times the width of the flow modifier to no more than 3.5 times the width of the flow modifier, or at least twice the width of the flow modifier to no more than three times the width of the flow modifier, for example. In further embodiments, the width of the axial length of the flow modifier can be substantially equal to the width of the flow modifier. Substantially means within 10%, within 5%, or within 2%, for example. The distance between the structural support and the downstream most edge of the flow modifier is no more than 2.5 times the axial length, no more than two times the axial length, or no greater than the axial length, for example.

If structural support 900 is not removed after manufacture, it can be aerodynamically suboptimal. Therefore, flow modifier 902 is placed upstream from structural support 900 to improve the aerodynamic properties of the structure by diverting flow path 904 around structural support 900. Using a flow modifier can decrease the thermally induced stress on the structural support and thereby increases the longevity of the heat exchanger.

Partial vanes and air flow modifiers described herein can be made by additive manufacture or any other suitable conventional methods. Additive manufacturing methods include but are not limited to vat photopolymerisation, material jetting, binder jetting, material extrusion, powder bed fusion, sheet lamination, or directed energy deposition. In some embodiments powder bed fusion by selective laser melting is used. In some embodiments the partial vanes and flow modifiers can be made from nickel, aluminum, titanium, copper, iron, cobalt, or some alloys or combination thereof. In other embodiments the partial vanes and flow modifiers can be made from Inconel 625, Inconel 718, Haynes 282, or AlSi10Mg, or a combination thereof.

Discussion of Possible Embodiments

The following are non-exclusive descriptions of possible embodiments of the present invention.

A system for heat exchange between a first fluid and a second fluid, the system comprising: a plurality of parting sheets defining a stack of alternating first and second fluid flow conduits, each of the first fluid flow conduits configured to conduct therein flow of a first fluid from a first input port to a first output port, each of the second fluid flow conduits configured to conduct therein flow of a second fluid from a second input port to a second output port, each of the parting sheets defining the first fluid flow conduits including: a plurality of vanes, extending: i) along a vane path from a leading edge to a trailing edge; and ii) between first and second parting sheets separating the first fluid flow conduit from first and second adjacent second fluid flow conduits, respectively, wherein the plurality of vanes are separated from one another in a direction transverse to the vane paths, thereby creating fluid flow channels therebetween; and a plurality of flow modifiers, each adjacent to a leading edge of a corresponding one of the plurality of vanes such that the corresponding leading edge is within a disrupted portion of a first fluid flow, wherein each of the plurality of flow modifiers protrudes from at least one of the first and second parting sheets and wherein flow modifier does not connect the first and second parting sheets.

The system of the preceding paragraph can optionally include, additionally and/or alternatively any one or more of the following features, configuration and/or additional components:

A further embodiment of the system, wherein: each of the plurality of flow modifiers further comprises a flow modifier width measured in the direction transverse to the vane path in the range from 0.006 inches to 0.020 inches.

A further embodiment of the system, wherein the flow modifiers are configured to decrease thermally induced stress on the vane in comparison to a system not including the flow modifiers.

A further embodiment of the system, wherein the flow modifiers are configured to decrease a pressure drop through the first conduit in comparison to a system not including the flow modifiers.

A further embodiment of the system, wherein: each of the plurality of flow modifiers further comprises a flow modifier width measured in the direction transverse to the vane path and each of the plurality of vanes comprises a vane width measured in the directions transverse to the vane path, and wherein the flow modifier width is substantially equal to vane width.

A further embodiment of the system, wherein: the flow modifier has an axial length measured along the vane path that is between one times and four times the flow modifier width.

A further embodiment of the system, further comprising: a leading edge distance measured from the leading edge to the flow modifier along the vane path, wherein the leading edge distance has a length of at least 1 times the axial length and no more than 2.5 times the axial length.

A further embodiment of the system, wherein: a second flow modifier is placed between the trailing edge and the outlet port, adjacent to the trailing edge of a corresponding one of the plurality of vanes.

A further embodiment of the system, further comprising: a trailing edge distance measured from the trailing edge to the second flow modifier along the vane path, wherein the second flow modifier comprises a second axial length measured along the vane path, and wherein the trailing edge distance has a length greater than zero and no more than one times the second axial length.

A further embodiment of the system, further comprising: a height direction normal to the vane path and normal to the vane width, wherein the plurality of vanes have a height measured along the height direction that is at least 0.050 inches and no more than 0.5 inches.

A further embodiment of the system, wherein: the flow modifier further comprises a profile in a cross section of the flow modifier taken through a plane parallel to the parting sheets, wherein the profile is a tear drop profile or an airfoil profile.

A further embodiment of the system, further comprising: a directional flow modifier between the flow modifier and the inlet port with a separation distance therebetween.

A further embodiment of the system, wherein: the plurality of flow modifiers further comprises a fillet at the intersection of the flow modifier and at least one of the first and second parting sheets.

A further embodiment of the system, wherein: the plurality of flow modifiers further comprises one or more of nickel, aluminum, titanium, copper, iron, cobalt, and alloys thereof.

A further embodiment of the system, wherein: the plurality of flow modifiers further comprises one or more of Inconel 625, Inconel 718, Haynes 282, or AlSi10Mg.

A further embodiment of the system, wherein: the vane comprises a vane width measured in directions transverse to the vane path and the leading edge comprises a leading edge width measured in directions transverse to the vane path, wherein the leading edge width is equal to the vane width proximate a vane terminus and the leading edge width increases along the vane path to a flare terminus proximate to the flow modifier, wherein the flare terminus has a width measured in directions transverse to the vane path greater than the vane width and wherein a profile of a leading edge in a plane defined by a height and the vane path is elliptical.

A further embodiment of the system, wherein: the flare width is at least 1 times and no more than 4 times the vane width.

A further embodiment of the system, wherein: the leading edge comprises a length from the vane terminus to the flare terminus along the vane path, and the flare distance is at least 1.0 times and no more than 4 times the width vane width.

A further embodiment of the system, wherein: each of the parting sheets defining the second fluid flow conduits comprises: a second plurality of vanes, extending: i) along a second vane path from a second leading edge to a second trailing edge; and ii) between first and second parting sheets separating the second fluid flow conduit from first and second adjacent first fluid flow conduits, respectively, wherein the second plurality of vanes are separated from one another in the direction transverse to the second vane paths, thereby creating fluid flow channels therebetween; and a second plurality of flow modifiers, each adjacent to a second leading edge of a corresponding one of the second plurality of vanes such that the second corresponding leading edge is within a second disrupted portion of a second fluid flow, wherein each of the second plurality of flow modifiers protrudes from at least one of the first and second parting sheet and wherein the flow modifier does not connect the first and second parting sheets.

A further embodiment of the system, further comprising: a secondary flow modifier and a structural support, the structural support comprising a support leading edge proximate to an inlet port and a support trailing edge proximate to an outlet port, wherein the secondary flow modifier is adjacent to a leading edge the structural support so as to cause a disrupted portion of the first fluid flow to be incident upon the support leading edge, and wherein the secondary flow modifier protrudes from at least one of the first and second parting sheets and wherein the flow modifier does not connect the first and second parting sheets.

A method for decreasing thermally induced stress on a vane in a heat exchanger, the method comprising: providing a plurality of parting sheets defining a stack of alternating first and second fluid flow conduits to a first and second fluids, each of the first fluid flow conduits configured to conduct therethrough flow of the first fluid from a first input port to a first output port, each of the second fluid flow conduits configured to conduct therethrough flow of the second fluid from a second input port to a second output port; presenting a plurality of vanes to the flow of the first fluid, the plurality of vanes extending: i) along a vane path from a leading edge to a trailing edge; and ii) between first and second of the parting sheets separating the first fluid flow conduit from adjacent second fluid flow conduits, respectively, wherein the plurality of vanes are separated from one another in a direction transverse to the vane paths thereby defining fluid flow channels therebetween; and presenting a plurality of flow modifiers to the flow of the first fluid, each of the plurality of flow modifiers adjacent to a corresponding leading edge of a corresponding one of the plurality of vanes such that the corresponding leading edge is within a disrupted portion of a first fluid flow, wherein each of the plurality of flow modifiers protrudes from at least one of the first and second parting sheets and wherein each of the plurality of flow modifiers does not connect the first and second parting sheets.

A further embodiment of the method, wherein the flow modifiers are configured to decrease thermally induced stress on the vanes in comparison to a system not including the flow modifiers.

A further embodiment of the method, wherein the flow modifiers are configured to decrease a pressure drop through the first conduit in comparison to a system not including the flow modifiers While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

We claim:

1. A system for heat exchange between a first fluid and a second fluid, the system comprising:

a plurality of parting sheets defining a stack of alternating first and second fluid flow conduits, each of the first fluid flow conduits configured to conduct therethrough flow of the first fluid from a first input port to a first output port, each of the second fluid flow conduits configured to conduct therethrough flow of the second fluid from a second input port to a second output port, each of the parting sheets defining the first fluid flow conduits including:

a plurality of vanes, extending:

i) along a respective vane path from a respective leading edge to a corresponding trailing edge; and ii) between first and second parting sheets of the plurality of parting sheets separating the first fluid flow conduit from two adjacent second fluid flow conduits, wherein the plurality of vanes are separated from one another in a direction transverse to the vane paths thereby defining fluid flow channels therebetween; and a plurality of flow modifiers, each adjacent to a corresponding leading edge of a corresponding one of the plurality of vanes such that the corresponding leading edge is within a disrupted portion of the first fluid flow, wherein each of the plurality of flow modifiers protrudes from at least one of the first and second parting sheets and wherein each of the plurality of flow modifiers does not connect the first and second parting sheets.

2. The system of claim 1, wherein each of the plurality of flow modifiers further comprises a flow modifier width measured in the direction transverse to the vane path in the range from 0.006 inches to 0.020 inches.

3. The system of claim 2, further comprising a leading edge distance measured from the corresponding leading edge to the flow modifier along the vane path, wherein the flow modifier has an axial length measured along the vane path that is between one times and four times the flow modifier width wherein the leading edge distance has a length of at least 1 times the axial length and no more than 2.5 times the axial length.

4. The system of claim 1, wherein the flow modifiers are configured to decrease thermally induced stress on the vanes in comparison to a system not including the flow modifiers.

5. The system of claim 1, wherein the flow modifiers are configured to decrease a pressure drop through the first conduit in comparison to a system not including the flow modifiers.

6. The system of claim 1, wherein each of the plurality of flow modifiers further comprises a flow modifier width measured in the direction transverse to the vane path and each of the plurality of vanes comprises a vane width measured in the directions transverse to the vane path, and wherein the flow modifier width is substantially equal to the vane width.

7. The system of claim 1, wherein a second flow modifier is placed between the trailing edge and the outlet port, adjacent to a corresponding trailing edge of a corresponding one of the plurality of vanes.

8. The system of claim 1, further comprising a height direction normal to the vane path and normal to the vane width, wherein each of the plurality of vanes has a height measured along the height direction that is at least 0.050 inches and no more than 0.5 inches.

9. The system of claim 1, wherein the flow modifier further comprises a profile in a cross section of the flow modifier taken through a plane parallel to the parting sheets, wherein the profile is a tear drop profile or an airfoil profile.

10. The system of claim 1, further comprising a directional flow modifier between the flow modifier and the inlet port with a separation distance therebetween.

11. The system of claim 1, wherein the plurality of flow modifiers further comprises a fillet at the intersection of the flow modifier and at least one of the first and second parting sheets.

12. The system of claim 1, wherein the plurality of flow modifiers further comprises one or more of nickel, aluminum, titanium, copper, iron, cobalt, and alloys thereof.

13. The system of claim 1, wherein the plurality of flow modifiers further comprises one or more of Inconel 625, Inconel 718, Haynes 282, or AlSi10Mg.

14. The system of claim 1, wherein each of the plurality of vanes comprises a vane width measured in directions transverse to the vane path and the corresponding leading edge comprises a leading edge width measured in directions transverse to the vane path, wherein the leading edge width is equal to the vane width proximate a vane terminus and the leading edge width increases along the vane path to a flare terminus proximate to the flow modifier, wherein the flare terminus has a width measured in directions transverse to the vane path greater than the vane width and wherein a profile of the corresponding leading edge in a plane defined by a height and the vane path is elliptical.

15. The system of claim 14, wherein the flare width is at least 1 times and no more than 4 times the vane width and wherein the leading edge comprises a length from the vane terminus to the flare terminus along the vane path, and the flare distance is at least 1.0 times and no more than 4 times the vane width.

16. The system of claim 1, wherein each of the parting sheets defining the second fluid flow conduits comprises:

a second plurality of vanes, extending:

i) along a respective second vane path from a respective second leading edge to a corresponding second trailing edge; and ii) between first and second parting sheets of the plurality of parting sheets separating the second fluid flow conduit from two adjacent first fluid flow conduits, wherein the second plurality of vanes are separated from one another in the direction transverse to the second vane paths thereby defining fluid flow channels therebetween; and a second plurality of flow modifiers, each adjacent to a corresponding second leading edge of a corresponding one of the second plurality of vanes such that the second corresponding leading edge is within a second disrupted portion of the second fluid flow, wherein each of the second plurality of flow modifiers protrudes from at least one of the first and second parting sheets and wherein each of the plurality of second flow modifiers does not connect the first and second parting sheets.

17. The system of claim 1, further comprising a secondary flow modifier and a structural support, the structural support comprising a support leading edge proximate to the first or second inlet port and a support trailing edge proximate to the first or second outlet port, wherein the secondary flow modifier is adjacent to the leading edge of the structural support such that the corresponding leading edge of the structural support is within a disrupted portion of the first fluid flow, and wherein the secondary flow modifier protrudes from at least one of the first and second parting sheets and wherein the secondary flow modifier does not connect the first and second parting sheets.

18. A method for making a heat exchanger, the method comprising:

providing a plurality of parting sheets defining a stack of alternating first and second fluid flow conduits to first and second fluids, each of the first fluid flow conduits configured to conduct therethrough flow of the first fluid from a first input port to a first output port, each of the second fluid flow conduits configured to conduct therethrough flow of the second fluid from a second input port to a second output port;

providing a plurality of vanes to the flow of the first fluid, the plurality of vanes extending:

i) along a respective vane path from a respective leading edge to a corresponding trailing edge; and ii) between first and second of the parting sheets separating the first fluid flow conduit from adjacent second fluid flow conduits, respectively, wherein the plurality of vanes are separated from one another in a direction transverse to the vane paths thereby defining fluid flow channels therebetween; and providing a plurality of flow modifiers to the flow of the first fluid, each of the plurality of flow modifiers adjacent to a corresponding leading edge of a corresponding one of the plurality of vanes such that the corresponding leading edge is within a disrupted portion of the first fluid flow, wherein each of the plurality of flow modifiers protrudes from at least one of the first and second parting sheets and wherein each of the plurality of flow modifiers does not connect the first and second parting sheets.

19. The method of claim 18, wherein the flow modifiers are configured to decrease thermally induced stress on the vanes in comparison to a system not including the flow modifiers.

20. The method of claim 18, wherein the flow modifiers are configured to decrease a pressure drop through the first conduit in comparison to a system not including the flow modifiers.

* * * * *